United States Patent [19]

Gablin

[11] 3,986,977

[45] Oct. 19, 1976

[54] METHODS OF DISPOSING OF RADIOACTIVE WASTE

[75] Inventor: Kenneth A. Gablin, Burton, Wash.

[73] Assignee: Nuclear Engineering Company, Inc., Louisville, Ky.

[22] Filed: Feb. 3, 1975

[21] Appl. No.: 546,314

[52] U.S. Cl. ..... 252/301.1 W; 260/39 R; 324/65 R

[51] Int. Cl.[2] ..... G21F 9/16

[58] Field of Search ..... 252/301.1 W; 324/65 R; 166/250; 260/39 R

[56] References Cited

UNITED STATES PATENTS 3,142,648 7/1964 Lefillatre et al. ..... 252/301.1 W

FOREIGN PATENTS OR APPLICATIONS 1,316,977 5/1973 United Kingdom

*Primary Examiner*—Leland A. Sebastian
*Assistant Examiner*—Deborah L. Kyle
*Attorney, Agent, or Firm*—Schapp & Hatch

[57] ABSTRACT

Methods are discussed for treating liquid and particulate radioactive waste materials for transportation and storage. The disclosed methods include the reading of an ohmmeter connected across a pair of separate and mutually insulated liquid level sensing electrical contacts arranged to contact the surface of a mixture of radioactive waste materials and a setting agent when a container is filled to a predetermined level with that mixture and determining from variations in the resistance between the sensing contacts the time when the mixture is solidified. The disclosed methods also include the flowing of a coating material such as the setting agent unmixed with the radioactive material over the surface of the solidified mixture after the resistance between the sensing contacts reaches a maximum and then causing the coating material to harden and produce a surface free of waste water.

3 Claims, 2 Drawing Figures

METHODS OF DISPOSING OF RADIOACTIVE WASTE

BACKGROUND OF THE INVENTION

This invention relates to methods and apparatus for disposing of radioactive wastes, and more particularly to methods and apparatus for solidifying radioactive waste liquids into hardened masses suitable for disposal by burying.

In particular this invention is an improvement upon the methods and apparatus shown and described in co-pending United States patent application Ser. No. 418,929, of Kenneth A. Gablin and Larry J. Hansen, filed Nov. 26, 1973.

As pointed out in said Gablin and Hansen application, radioactive wastes such as liquid waste materials from nuclear reactors are conventionally disposed of by burying them in the earth or dumping them at sea. To prevent contamination of the surrounding environment these waste materials, sometimes liquids containing solid radioactive waste materials in suspension, are incorporated in solid shielding bodies.

Various attempts have been made to obtain solid suspensions of these materials in a commercially acceptable manner. However, a number of problems are encountered, and none of the prior art expedients are completely satisfactory. Prior to the invention of Said Gablin and Hansen application solid radioactive wastes were fixed by means of glass, bitumen, asphalt and similar materials, and also by means of emulsified asphalt, polyester and polyethylene. The latter materials did not prove to be practicable, and almost all of the encapsulation of liquid radioactive waste materials prior to the advent of the invention of the said Gablin and Hansen application was accomplished by mixing them with Portland Cement and allowing the resulting concrete-like mass to harden.

As pointed out in said Gablin and Hansen application, however, many unsolved problems arose in connection with the use of Portland Cement and these problems were solved to a practical extent only upon the advent of the invention of that application, which provides a setting agent capable of solidifying large quantities of water (the liquid most often encountered in radioactive waste disposal problems) and holding this water and other radioactive waste materials in a solid body well suited for transportation and burial.

The described setting agent of said Gablin and Hansen application is a water extendable polymer consisting of an aqueous suspension of urea formaldehyde, usually in partially polymerized form. This material is very "forgiving" in critical areas of surface tension and pH and can be used in many proportions to form solids of various strengths. This setting agent is capable of taking up comparatively large volumes of water as the mass solidifies. Control over the rate of solidification is easily obtained by varying the amount of curing agent used, and the curing agent is a low-cost commercially available reducing agent. Increasing the concentration of the curing agent shortens the solidification time as well as the time necessary to obtain the full potential strength of the mass. Raising the temperature of the mass also speeds up the solidification action. The said Gablin and Hansen application discloses a system of apparatus for mixing, proportioning, holding, heating, etc., of radioactive waste material, the said setting agent, and the said curing agent in order to encapsulate radioactive waste materials from reactors and the like in solid bodies suitable for transportation and storage by burial.

The proportioning aspects of the methods and apparatus of said Gablin and Hansen application make it possible to provide a resulting solidified mass which meets the LSA (Low Specific Activity) standards imposed by law in connection with the transportation and handling of radioactive materials.

With the levels of radioactivity encountered in nuclear reactor waste materials it is usually necessary to provide shielding during the handling attendant upon encapsulation for transportation and burial. This shielding and the necessity for generally protecting the operator of the mixing apparatus from exposure to radiation to the maximum possible degree renders extremely difficult certain simple method steps which in processing nonradioactive substances would offer no substantial difficulty.

Thus, determining when a mass of admixed radioactive waste material and setting agent is fully solidified must be determined by indirect instrumental means, since the operator of the apparatus of the Gablin and Hansen invention cannot be directly exposed for extended periods to the mass of radioactive material and setting agent.

Further, it is highly desirable to prevent the occlusion of radioactive waste water on the top surface of the mixed, solidified mass of radioactive waste material and setting agent.

It is therefore a principal object of the present invention to provide methods and apparatus whereby the operator of apparatus of the kind shown and described in the said Gablin and Hansen application can without exposure to the admixed mass of radioactive waste material and setting agent accurately determine when the admixed mass is fully solidified.

It is a further object of the present invention that such method be capable of being carried out without the employment of expensive sensing means, which must be buried or otherwise disposed of with the solidified mass.

It is a yet further object of the present invention to provide a method whereby an operator of the apparatus shown and described in said Gablin and Hansen application can determine with accuracy the time when the mass of radioactive waste material and setting agent is fully solidified but occlusion of waste water has not gone forward to a substantial degree.

It is an additional object of the present invention to provide methods whereby operators of apparatus of the kind shown and described in said Gablin and Hansen application can, after flowing coating material such as substantially pure urea formaldehyde over the mass, determine when this coating material has substantially completely absorbed the occluded surface water.

Other objects and features of the advantage inherent in the methods and apparatus of the present invention will become apparent as the specification and claims continue.

Figure 1:
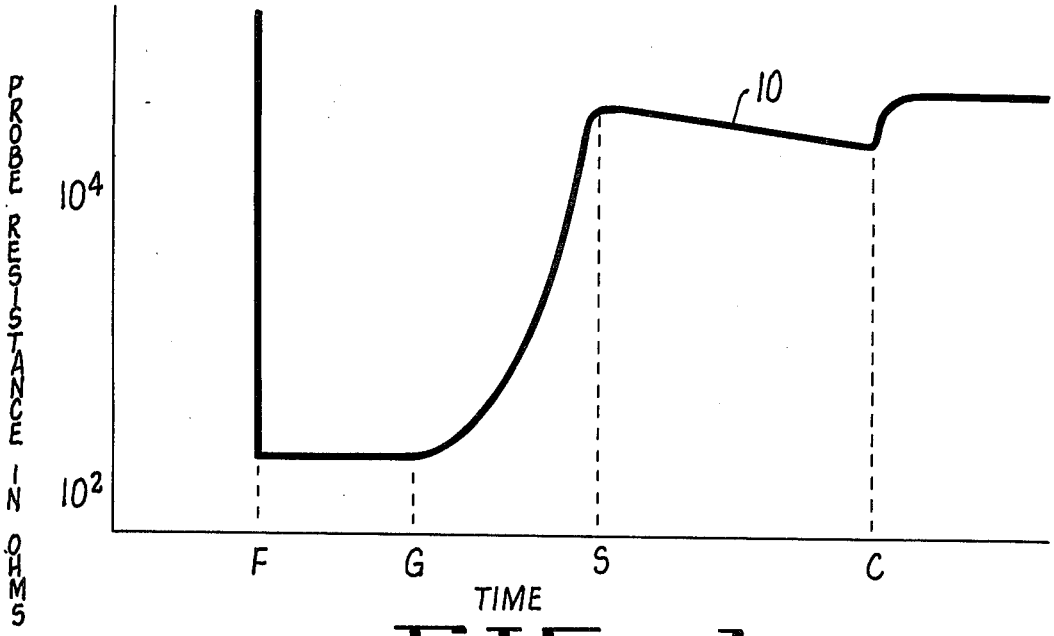
FIG. 1 is an idealized schematic representation of the relationship between the resistance measured across the sensing contacts of the liquid level gauge of FIG. 2 and the progress of the formation of a solidified mass of radioactive waste and setting agent suitable for transportation and burial.

While only elementary apparatus for use in carrying out the methods of the present invention are shown in the drawing, it will be apparent to those having ordinary skill in the art that other apparatus could be provided without the exercise of invention whereby the methods of the invention could be carried out semi-automatically or fully automatically, and it is to be understood that such alternative apparatus falls within the ambit of the present invention as defined in the claims appended hereto.

DESCRIPTION OF THE PREFERRED EMBODIMENT

Referring to the drawings in detail, it is to be understood that the resistance curve 10 of FIG. 1 is derived from an ohmmeter 12 (FIG. 2), ohmmeter 12 being connected by means of two electrical leads 14, 16 to respective ones of a pair of electrical contacts 18, 20 which are partially submerged in a mass 22 of admixed radioactive waste material and the setting agent of said Gablin and Hansen application contained in a receiving container 24 which is itself surrounded by shield 26.

Receiving containers and shields of this general kind are shown in and described in connection with FIGS. 12 and 13 of said Gablin and Hansen application, a liquid level sensor of the kind shown in FIG. 2 of the present application, and there designated by the reference numeral 28, being identified in FIG. 12 of said Gablin and Hansen application by the reference numeral 103.

Figure 2:
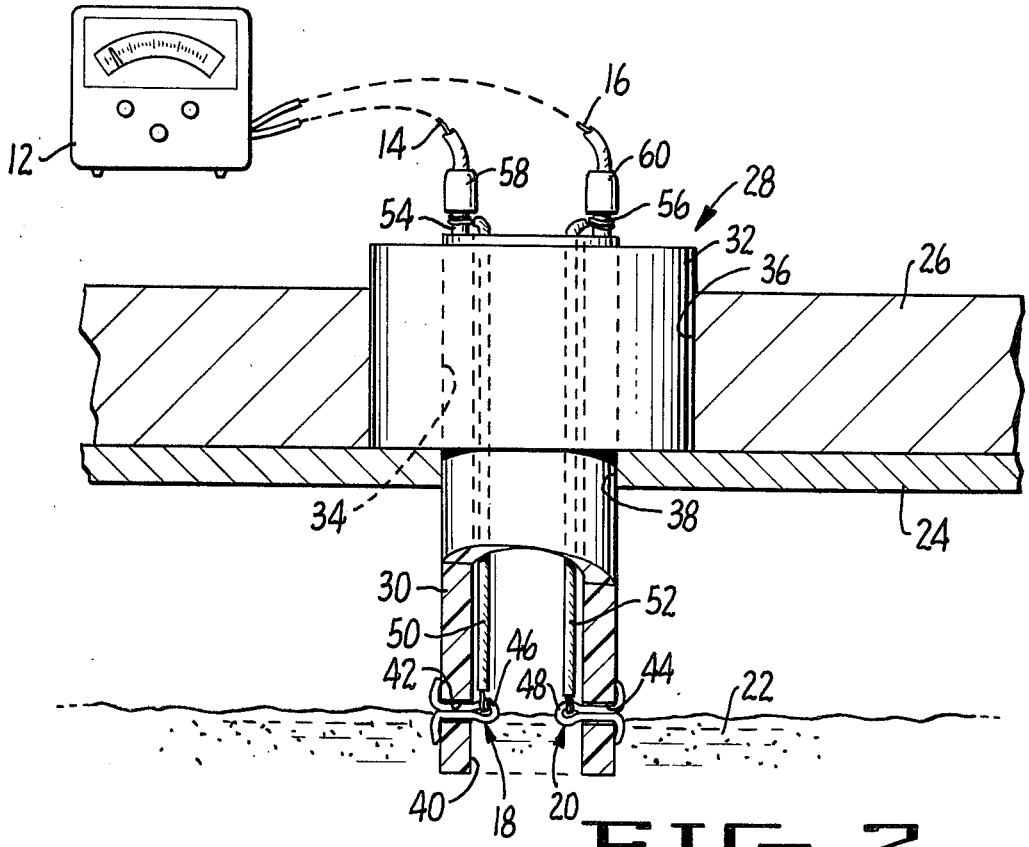
FIG. 2 is a partial view in elevation and section of a receiving tank and surrounding shield of the invention of said Gablin and Hansen application illustrating the construction and operation of a typical liquid level sensing device interconnected with an ohmmeter for use in carrying out the method of the present invention.

Going to FIG. 2, it will be seen that liquid level sensor 28 comprises a hollow cylindrical member 30 received in a second hollow cylindrical member 32.

Hollow cylindrical member 30, hereinafter called the electrode support, is affixed within a close-fitting bore 34 in hollow cylindrical member 32, hollow cylindrical member 32 being hereinafter called the plug.

As shown in FIG. 2, plug 32 is adapted to loosely fit in bore 36 which passes through shell 28, and thus to rest upon the top surface of container 24 immediately surrounding a hole 38 in the top surface of receiving container 24, hole 38 being of such diameter as to loosely fit electrode support 30. If desired or required by regulation or regulatory authorities plug 32 may be provided with threads on its outer surface adapted to interengage with threads provided in the wall of bore 36, whereby liquid level sensor 28 may be removably fixed in shield 26.

As also shown in FIG. 2, the bore 40 of electrode support 30 extends completely from end to end of electrode support 30 and thus mass 22 is not impeded from rising within bore 40 as the admixed radioactive waste material and setting agent are pumped into receiving container 24.

Diametrically directed holes 42, 44 are provided in the lower end of electrode support 30 for receiving the shanks of electrical contacts 18 and 20, which may be cotter keys of the well known type commonly used in mechanical applications.

As shown in FIG. 2, the heads 46 and 48 of electrical contacts 18 and 20 are located inside bore 40, while the legs of electrical contacts 18 and 20 are passed through holes 42 and 44, respectively, and then headed over on the outside surface of electrode support 30, whereby heads 46 and 48 are maintained at a fixed distance from each other by electrode support 30.

Connection from electrical contacts 18 and 20 to the exterior of the receiving tank is provided by means of insulated leads 50 and 52, which are themselves directly connected to heads 46 and 48, respectively, and connected at their upper ends directly to a pair of terminals 54 and 56, insulated leads 50 and 52 passing through bore 40 of electrode support 30 closely adjacent the wall of bore 40, all as shown in FIG. 2.

As also shown in FIG. 2, electrical leads 14 and 16 are supplied with connectors 58 and 60, respectively, whereby electrical connection is made between electrical lead 14 and terminal 54 and between electrical lead 16 and terminal 56, and thereby the resistance measuring terminals of ohmmeter 12 are connected directly to the heads 46 and 48 of electrical contacts 18 and 20, respectively.

Typically, receiving container 24 may be of cylindrical configuration, about 48 inches deep and 48 inches (horizontal) in diameter. Further details of such receiving container are given in said Gablin and Hansen application. Electrode support 30 may be fabricated, for instance, from polyvinyl chloride pipe having an outer diameter of about 2¾ inches, and being of such length that contact heads 46 and 48 are located approximately 3 inches below the lower surface of the top of receiving container 24. In some embodiments it may be desired to provide an additional pair of electrical contacts about 2 inches above electrical contacts 18 and 20, as shown in FIG. 2; these additional electrical contacts being provided with separate leads, and being used in connection with an electrical safety system which automatically initiates certain plant safety measures in the event that the filling of container 24 with liquid mass 22 proceeds so far that the upper surface of mass 22 reaches these upper contacts. It is to be understood, however, that in normal operation electrical contacts 18 and 20 only are used, the filling of container 24 with mass 22 being terminated either manually or automatically when the top surface of mass 22 reaches and first comes into contact with electrical contacts 18 and 20, thereby very substantially reducing the resistance measured between heads 46 and 48 by ohmmeter 12, or by automatic resistance sensing means of the kind employed in the radioactive waste material packaging system shown and described in said Gablin and Hansen application.

Going to FIG. 1, an example of the carrying out of the method of the present invention will now be described.

The vertical axis of the idealized resistance variation plot of FIG. 1 may be thought of as being graduated in magnitude values of resistance in ohms, as measured across the gap between heads 46 and 48 (FIG. 2) by ohmmeter 12 (FIG. 2).

The horizontal axis of the idealized resistance change plot of FIG. 1 may be thought of as being graduated in terms of elapsed times, commencing at 0 when the filling of receiving container 24 (FIG. 2) with a mass of admixed radioactive waste material and its setting agent commences, and extending to and beyond C, C being the time when a quantity of hygroscopic surface hardening material is flowed over the surface of mass 22 (FIG. 2) in a relatively thin layer.

During the interval OF, as shown in FIG. 1, the liquid or slurry of mass 22 is being pumped into receiving tank 24.

At time F, as shown in FIG. 1, the upper surface of mass 24 reaches and comes into contact with electrical contacts 18 and 20, whereupon the resistance indicated by ohmmeter 12 drops from the infinity indication to a very low value, e.g., 200 ohms.

In a typical example of the employment of the method of the present invention, mass 22 may consist of premeasured portions of a highly concentrated solution of boric acid and other radioactively contaminated waste material representing the dregs drained from the evaporators utilized to purify the water used in a reactor (see page 13 of said Gablin and Hansen application) and the setting agent of said Gablin and Hansen application, which is made and sold by the assignee of the present application and said Gablin and Hansen application under the trademark TigerLock (see page 5 of said Gablin and Hansen application).

Returning to FIG. 1, the interval FG, the duration of which is shown only schematically and not to scale, is the time during which a curing agent (see page 5 of said Gablin and Hansen application), heat, or both of them, is added or applied to mass 22.

At about time G (FIG. 1) jelling or solidification of mass 22 begins.

It is at this time (immediately to the right of G in FIG. 1) that it is desirable to remove the drive shaft of the mass agitator if one is used (see agitator 181 in FIG. 13 of said Gablin and Hansen application).

Thus, it will be seen that one advantage of the present method lies in the fact that the operator of the apparatus of said Gablin and Hansen application is warned by an initial rise in the resistance indicated on ohmmeter 12 to remove the drive shaft of the agitator used to agitate mass 22 if one is employed. It will, of course, be evident to those having ordinary skill in the art that suitable alarm means such as manually positionable photoelectric means actuated by the upward travel of the indicator of ohmmeter 12 may be provided to actuate alarm means for alerting the operator to remove the agitator drive shaft.

Returning to FIG. 1, it will be seen that the resistance indicated by ohmmeter 12 rises over the interval GS to a knee or maximum point at time S. It has been observed that when solidifying a mass 22 of the materials of this example, viz., radioactive boric acid waste and TigerLock setting agent, the knee or peak at time S corresponds to a resistance value as measured by ohmmeter 12 of approximately 20,000 ohms.

It has also been observed in the reduction to practice of this invention that after reaching the knee or peak at S the resistance measured across contact heads 46 and 48 declines from the knee or peak value as surface water develops on the top of the solidified mass, this decline of the resistivity value being indicated by the segment SC of the resistivity plot of FIG. 1.

It will now be understood that by making use of the method of the present invention the operator of the apparatus of said Gablin and Hansen application is able to very accurately determine the time when full solidification of the mass 22 has occurred even though due to protective shielding the operator cannot visually observe the surface of mass 22 or stir or manipulate mass 22.

This accurate indication of the time of substantially full solidification is also very advantageous in carrying out the additional step of providing mass 22 with a water absorbing overlayer, which step is a characteristic feature of the novel and inventive process carried out by the apparatus made and sold by the assignee of the present application and said Gablin and Hansen application, this step being known as the "PPI coat process".

In accordance with the PPI coat process, a body of TigerLock setting agent is flowed onto the top surface of mass 22, followed by a suitable quantity of its curing agent, producing a hard upper surface which absorbs the surface water occluded from mass 22.

The flowing of TigerLock setting agent and curing agent onto the upper surface of mass 22 is indicated in idealized fashion as occurring at time C in FIG. 1.

As also shown in FIG. 1, by the rise of the resistance plot occurring immediately to the right of time C, the absorption of surface water by the superposed body of TigerLock setting agent results in the resistance measured across contact heads 46 and 48 rising to a relatively high value.

Thus it will be seen that by employing the method of the present invention the operator of apparatus of the type shown and described in said Gablin and Hansen application is provided with a positive indication that the PPI coat process has been carried out to a satisfactory conclusion and that the process of producing a solidified mass of admixed radioactive boric acid and TigerLock setting agent is complete.

It will thus be seen that the objects set forth above, among those made apparent from the preceding description, are efficiently attained, and since certain changes may be made in carrying out the above method without departing from the scope of the invention it is intended that all matter contained in the above description shall be interpreted as illustrative only and not in a limiting sense.

It is also to be understood that the following claims are intended to cover all of the generic and specific features of the invention hereindescribed and all statements of the scope of the invention which as a matter of language might be said to fall therebetween.

I claim:

1. A method of disposing of at least partially radioactive waste material, comprising:

intermixing such waste material with a liquid containing a setting agent consisting of an aqueous suspension of partially polymerized urea formaldehyde capable of forming with said waste material, upon mixing with a curing agent, a free standing hardened mass;

placing the resulting mixture in a container;

maintaining two spaced apart electrodes in contact with said mixture at or near the free surface thereof;

monitoring the resistance between said electrodes;

adding to said mixture a proportionate amount of a curing agent capable of hardening said mixture to a free standing hardened mass;

retaining said mixture in said container until said resistance reaches a maximum and slightly declines therefrom; and burying said container and its solidified mixture for disposal.

2. A method of disposing of at least partially radioactive waste material as claimed in claim 1, wherein said waste material includes reactor evaporator bottoms.

3. A method of disposing of at least partially radioactive waste material as claimed in claim 1, wherein additional amounts of said setting agent and curing agent are mixed together and added to the mass in said container after said resistance reaches a maximum and declines therefrom, said additional amounts of setting agent and curing agent at least covering the free surface of said mixture.

* * * * *